United States Patent [19]

Endres

[11] Patent Number: 4,656,973

[45] Date of Patent: Apr. 14, 1987

[54] TEMPERATURE RESPONSIVE ENGINE CONTROL APPARATUS

[75] Inventor: Mark C. Endres, Oregon City, Oreg.

[73] Assignee: Instrument Sales and Service, Inc., Portland, Oreg.

[21] Appl. No.: 641,623

[22] Filed: Aug. 17, 1984

[51] Int. Cl.[4] ..... F02B 77/00

[52] U.S. Cl. ..... 123/41.15; 123/198 D

[58] Field of Search .... 123/198 D, 198 DC, 198 DB, 123/41.49, 41.15

[56] References Cited

U.S. PATENT DOCUMENTS

| | | | |
|---|---|---|---|
| 3,533,391 | 10/1970 | Lockmuller | 123/198 DB |
| 3,680,539 | 8/1972 | Savage | 123/198 DB |
| 4,020,814 | 5/1977 | Hewitt | 123/198 DB |
| 4,088,110 | 5/1978 | Sperline | 123/198 DB |
| 4,378,760 | 4/1983 | Barge | 123/41.49 |

FOREIGN PATENT DOCUMENTS

| | | | |
|---|---|---|---|
| 767381 | 9/1980 | U.S.S.R. | 123/198 |

*Primary Examiner*—Craig R. Feinberg
*Assistant Examiner*—David A. Okonsky
*Attorney, Agent, or Firm*—Klarquist, Sparkman, Campbell, Leigh & Whinston

[57] ABSTRACT

A method and apparatus is disclosed for continuing the cooling of an engine, such as a turbo-charged equipped truck engine, at times when the engine temperature is elevated. In the illustrated form of the invention, the temperature of the engine is sensed. An engine control circuit bypasses the ignition switch at times when the sensed engine temperature is above a predetermined temperature and prevents the ignition switch from shutting off the engine under such conditions. The engine continues to operate, even though the ignition switch is off, until such time as the engine cools and the sensed temperature drops to the predetermined reference level. The predetermined temperature is adjustable to vary the temperature at which the engine is allowed to shut off. The apparatus includes optional indicator and override mechanisms.

4 Claims, 3 Drawing Figures

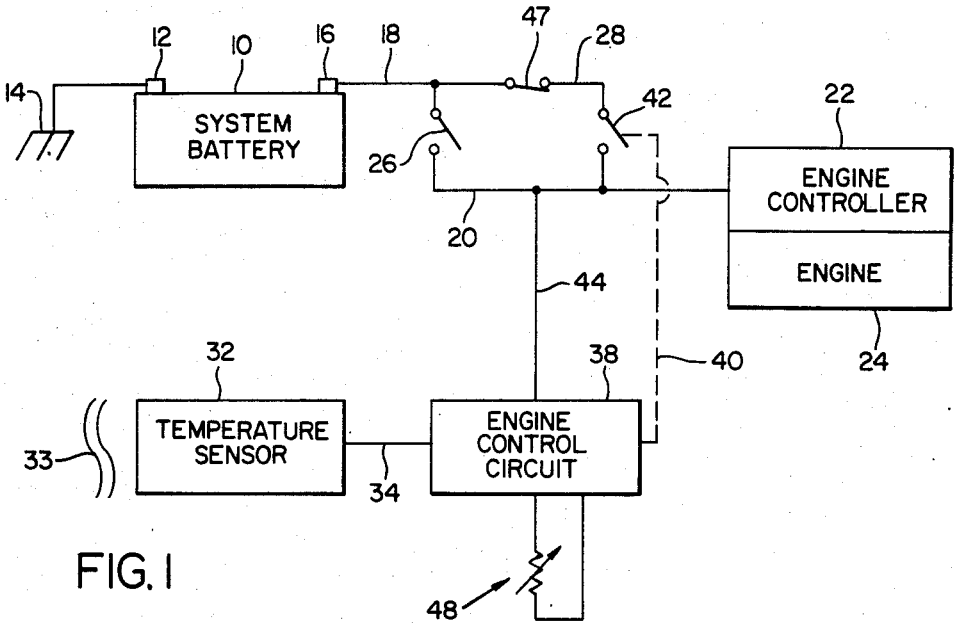
FIG. 1
FIG. 2
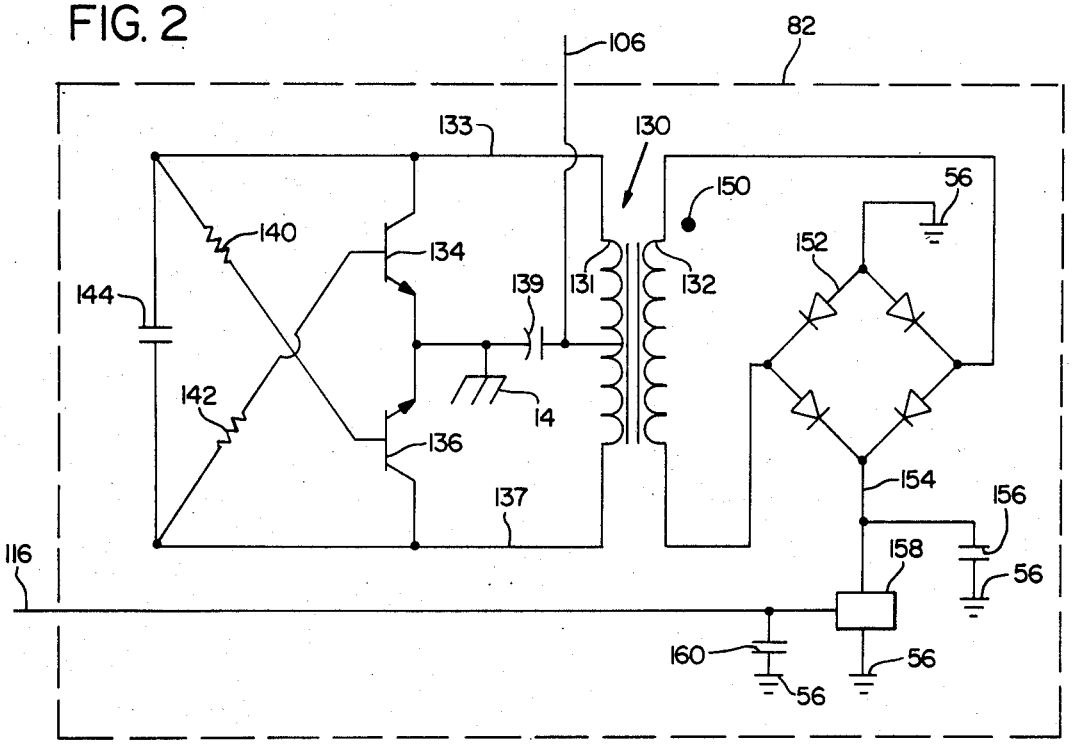

TEMPERATURE RESPONSIVE ENGINE CONTROL APPARATUS

BACKGROUND OF THE INVENTION

1. Field of the Invention

The present invention relates to an engine control apparatus for continuing the cooling of an engine following the shutting off of the engine's ignition switch or other actuating mechanism. The invention is particularly applicable to controlling the operation of turbocharger equipped vehicle engines so as to minimize the risk of engine and bearing damage from overheating.

2. Description of the Prior Art

During operation, vehicle engines generate significant amounts of heat. This heat is commonly dissipated by coolant, such as lubricating oil circulating through the engine and components. Alternately, cooling is frequently accomplished by air or other fluid circulating through a heat exchanger in heat exchange relationship with the engine and components. These engines are turned on and off by an ignition switch. When the ignition switch is turned off, the engine, and also the circulation of lubrication fluid and coolant through the engine, stops. This subjects the engine and bearings to damage from overheating in the event the engine is at a high operating temperature when turned off.

This problem is particularly acute in turbo-charger equipped diesel or gasoline truck engines. When under heavy load, the turbo-chargers of such engine heat up substantially. Then, when the vehicle ignition switch is turned off, elevated temperatures within the turbocharger may evaporate and break down lubricant within the turbo-charger bearings. This results in bearing failure and seizing up of the turbo-charger shaft and leads to expensive repairs and lost vehicle use.

In an attempt to address these problems, one prior art device has a timer for continuing the operation of a vehicle engine for a preset period of time after the vehicle ignition switch is turned off. As a result, coolant is circulated through the engine during this time, rather than stopping when the ignition switch is turned off. Although this approach does result in further cooling of the engine, there are a number of disadvantages to such devices.

For example, manufacturers of engines typically establish an optimum safe engine shut-off temperature. When an engine is shut off at or below this optimum temperature, the risk of damage to the engine and bearings of an engine turbocharger is minimal. With the prior art devices, under given operating conditions, the time set by the timer may be longer or shorter than necessary for the engine temperature to drop to a desired safe temperature level. If too long, unnecessary fuel is used and unnecessary engine wear is incurred because the engine operates longer than needed to cool it to a safe level. If the time is too short, the engine temperature may be above a safe level when the engine shuts off. Therefore, significant risk of damage to the engine is still present.

Therefore, a need exists for an apparatus, particularly applicable to vehicular engines having turbo-chargers, which continues to cool and lubricate the engine after the vehicle's ignition switch is shut off, which minimizes the risk of engine damage from overheating, and which minimizes engine wear and fuel usage.

SUMMARY OF THE INVENTION

The present invention relates to a method and apparatus for continuing the cooling of an engine, such as a turbocharger equipped truck engine, at times when the engine temperature is elevated and following the shutting off of the engine ignition switch.

More specifically, in one illustrated form of the invention, the temperature of the engine is sensed. In addition, an engine control circuit bypasses the ignition switch at times when the sensed engine temperature is above a desired level. As a result, the engine continues to operate under such elevated temperature conditions. While the engine operates, lubricant and coolant is circulated. This keeps engine components lubricated and also causes the engine temperature to drop. When the sensed engine temperature is reduced to a desired predetermined level, the bypass circuit is opened and the engine shuts off.

As a more specific optional feature of the invention, an adjustment mechanism is provided for varying the predetermined engine temperature at which the engine shuts off. Because of design and operating differences, different engines may be shut off at different temperatures without significant risk of damage. This feature enables adjustment of the predetermined engine shut off temperature so that the shut off temperature may be set at the optimum level for the specific engine which the apparatus is controlling.

As still another optional feature of the invention, manual override means is provided, such as a manually activated override switch, for disabling the apparatus and allowing the engine ignition switch to shut off the engine, if desired.

As still another optional feature of the invention, an indicator means, such as a lamp, is provided for indicating that the engine is operating above the predetermined temperature. This enables the vehicle operator to verify that, when the engine is at an elevated temperature, it continues to operate after the ignition switch is turned off.

It is accordingly one object of the present invention to provide an improved method and apparatus for continuing the cooling of an engine after the ignition switch or other engine actuating mechanism is turned off.

It is still another object of the invention to provide a method and apparatus for selectively continuing the operation of a turbo-charger equipped truck or other engine after the engine ignition switch is off, in response to the temperature of the engine, to continue the lubrication and cooling of the engine.

Another object of the invention is to provide a method and apparatus for cooling an engine, which minimizes the risk of engine damage, from overheating, as well as minimizes fuel consumption and engine wear.

A further object of the invention is to provide an engine temperature responsive cooling apparatus which is automatically operable to cool an engine after the engine ignition switch or other actuating mechanism is turned off.

A further object of the invention is to provide an engine cooling apparatus which is easy to install in both new and existing vehicles, and which is easy to maintain.

These and other objects, features, and advantages of the present invention will become apparent from the drawings and description below.

BRIEF DESCRIPTION OF THE DRAWINGS

FIG. 1 is a block diagram of one form of a temperature responsive engine cooling apparatus in accordance with the present invention;

FIG. 2 is a schematic circuit diagram of a voltage generator portion of the engine control circuit of FIG. 1.

DETAILED DESCRIPTION OF PREFERRED EMBODIMENT

Figure 3:
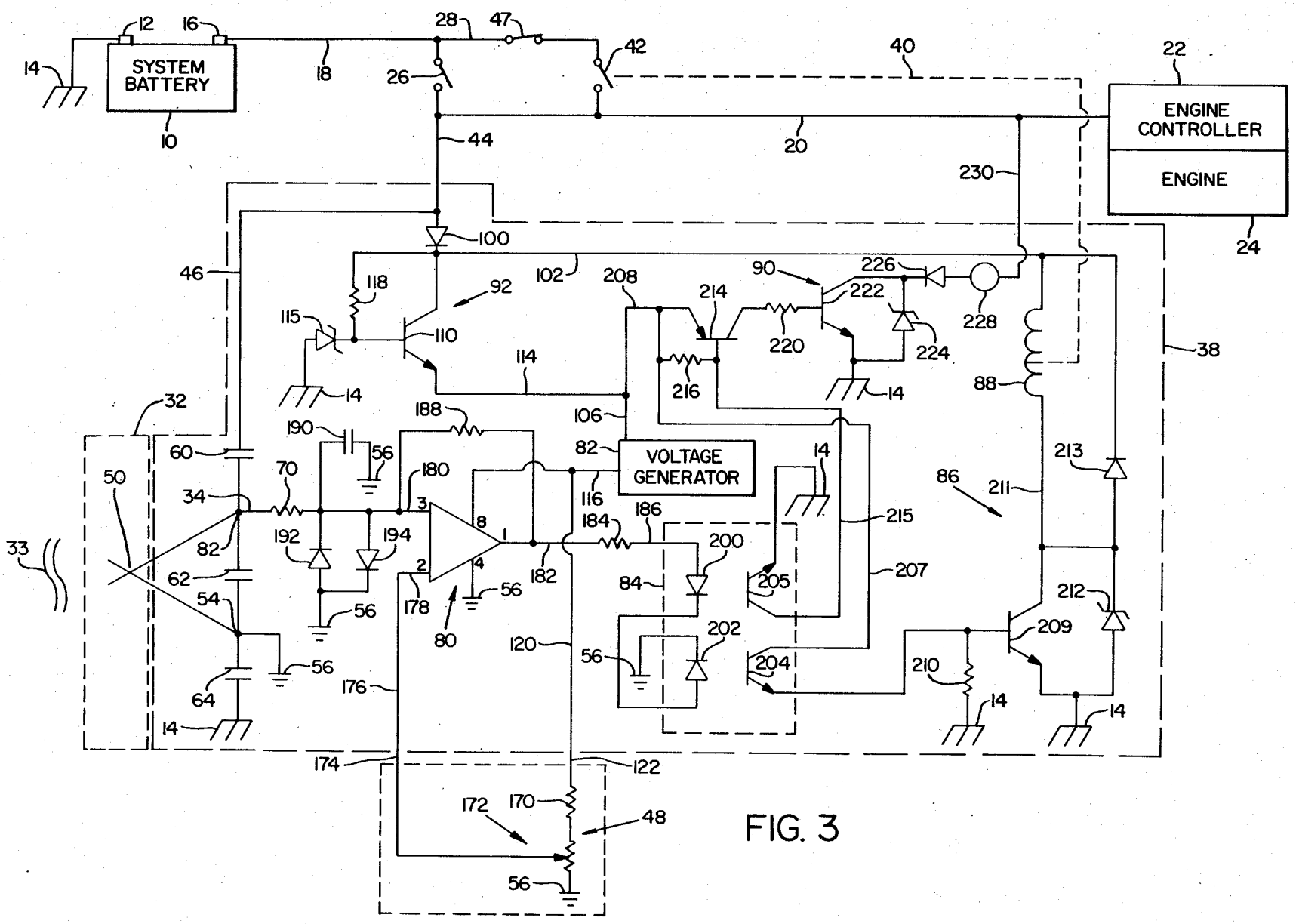
FIG. 3 is a schematic circuit diagram of the apparatus of FIG. 1, with the voltage generator of FIG. 2 shown in block diagram form.

With reference to FIG. 1, the present invention will be described in a specific application to a turbo-charger equipped diesel or gasoline powered truck engine, it being understood that the apparatus is applicable to other engines, as well.

A typical truck of this type includes a system battery 10 having its negative terminal 12 connected to a system ground 14. The positive terminal 16 of the battery is connected by conductors 18 and 20 to an engine controller 22. The engine controller is operatively connected to an engine 24 in a conventional manner. In a diesel engine, the engine controller 22 is typically a diesel fuel solenoid which controls the flow of diesel fuel to the engine. In a gasoline powered engine, engine controller 22 is typically the ignition circuit of the engine. An operating mechanism, such as an ignition switch 26, is provided for selectively opening the circuit path between the conductors 18 and 20. When switch 26 is closed, power is supplied to the engine controller 22, as well as to the dash and other components of the vehicle, and the engine 24 starts operating. When switch 26 is opened, the supply of power through the switch 26 to the engine controller 22 is interrupted, and, in the absense of the apparatus of the invention, the engine shuts off.

In a typical engine, while the engine runs, oil or other fluid is circulated through the engine and also to bearings of the engine turbo-charger. This fluid lubricates and cools these bearings and the engine. Alternately, radiator or other cooling fluid is circulated through a heat exchanger in heat exchanging relationship with the engine to dissipate heat and also lubricating oil is circulated. Thus, the engine is cooled while it operates to prevent damage to engine bearings and other components. In contrast, when the engine is shut off, the circulation of coolant stops, leading to possible overheating and failure of turbo-charger bearings.

In the illustrated preferred embodiment of the invention, a bypass circuit path is provided and includes a conductor 28 connected in parallel with switch 26 between the conductors 18 and 20. A temperature sensor 32 is provided and positioned to sense the temperature of the engine 24. For example, sensor 32 may be positioned in contact with engine exhaust gases 33. Of course, sensor 32 may be positioned at any convenient location to provide either a direct or indirect measurement of the engine temperature. Signals corresponding to the magnitude of the sensed temperature are transmitted from sensor 32, along a conductor 34, to an engine control circuit 38. The engine control circuit in turn, depending upon the magnitude of the sensed temperature, transmits relay control signals along a path 40 to a relay 42 located in the circuit path along conductor 28. These relay control signals selectively operate relay 42 to open and close the conductor path in response to engine temperature.

Specifically, whenever the sensed engine temperature is below a desired level at which the risk of damage to engine bearings is minimal, engine control circuit 38 allows the normally open relay switch 42 to remain open. Therefore, when ignition switch 26 is opened, the engine shuts off. In contrast, when the engine temperature is at or above a level at which there is a significant risk of engine damage if cooling and lubrication of the engine were stopped, engine control circuit 38 causes relay switch 42 to close. Under this condition, even if the ignition switch 26 is opened, power is supplied along conductor 28 through relay 12 to the engine controller 22. Therefore, the engine 24 continues to operate and coolant is circulated through the engine. After the sensed engine temperature drops to a desired safe level, the engine controller 38 allows relay switch 42 to reopen. Then, as long as ignition switch 26 is still open, power to the engine controller 22 is interrupted and the engine 24 shuts off.

A conductor 44 is connected from conductor 20 to the engine control circuit 38. Conductor 44 provides a path along which power is initially delivered to the engine control circuit 38 upon closing of the ignition switch 26. After relay 42 is closed, power is supplied to the engine control circuit 38 via conductors 18, 28, 20 and 44 even after the ignition switch is opened.

In addition, a normally closed optional manually actuated override mechanism comprising a switch 47 is included in the circuit path along conductor 28. When switch 47 is open, the engine operates as if the temperature responsive system were not included. That is, whenever the ignition switch 26 is open, power to the engine controller 22 is interrupted and the engine stops.

Manufacturers of engines typically specify an optimum safe temperature at which the engine may be shut off without significant risk of damage from overheating. The actual safe temperature is usually higher than the specified temperature as manufacturers normally build a safety margin into their optimum temperatures. Thus, there is a range of temperatures at which an engine may be shut off without significant risk of damage. It is desirable to stop the engine as soon as the engine temperature drops to a satisfactory level which minimizes the risk of engine damage. This level may be at or somewhat above the manufacturer's specified optimum temperature. If the engine is shut off substantially above the desired level, the turbocharger components and bearings may be damaged. In contrast, if the engine is allowed to continue to run until cooled substantially below the optimum level, fuel is wasted and unnecessary engine wear results.

In the present invention, a reference temperature signal generating circuit 48 is provided for setting the engine shut-off temperature at which the engine control circuit 38 operates the relay 42. Optionally, reference generator 48 is capable of adjusting the engine shut-off temperature. This enables the engine shut-off temperature to be varied to, for example, more closely match a truck manufacturer's specified optimum safe shut-off temperatures for the truck.

With reference to FIG. 3, the details of the specifically illustrated engine control circuit and temperature sensor will next be described.

In particular, the illustrated temperature sensor 32 comprises a thermocouple 50 connected to provide an output on conductor 34 which corresponds to the magnitude of the engine temperature sensed by the thermocouple. That is, the voltage between the thermocouple contacts 82 and 54 corresponds in a well known manner to the sensed temperature. The contact 54 is connected to an isolated ground 56 of the engine control circuit 38 so that the output on conductor 34 is at a proper level, with reference to circuit ground 56, for use by the engine control circuit. Thus, the magnitude of the voltage on conductor 34 varies with the sensed temperature and comprises a small positive DC signal relative to the ground 56. Therefore, the temperature sensor 32 provides an output at conductor 34 which corresponds to the sensed temperature of the engine 24.

With continued reference to FIG. 3, the engine control circuit 38 receives the signal along conductor 34 and compares this signal with a reference temperature signal from the reference temperature generator 48. Whenever the sensed temperature exceeds the predetermined engine shut-off temperature, the engine control circuit 38 transmits a signal on line 40 to close relay 42. This causes the engine to continue to operate after the ignition switch 26 is opened, as previously explained.

More specifically, the illustrated engine control circuit 38 includes a comparator circuit 80 for comparing the sensed temperature signal from sensor 32, which corresponds to the sensed engine temperature, with the reference temperature signal from reference generator 48, which corresponds to a predetermined reference temperature. Circuit 38 also includes a voltage generator 82 which comprises a DC voltage source and an optical coupler circuit 84 for electrically isolating the comparator 80 and other portions of the circuit 38 from the system battery circuit. In addition, circuit 38 includes a relay driving circuit 86 with a relay coil 88, and a system monitoring circuit 90 for providing an indication to the vehicle driver of the engine's temperature. Furthermore, the engine control circuit 38 includes a series regulator signal transient protection circuit section 92. Each of these circuit sections will next be described.

Power is supplied to the circuit 38 along conductor 44. To protect the circuit, conductor 44 is connected directly to the anode of a diode 100, within the circuit 38, which in turn has its cathode connected to a conductor 102. The diode 100 protects the circuit against incorrect installation, by blocking current flow in the event conductor 44 is mistakenly coupled to the negative terminal 12 of the system battery.

The engine control circuit 38 also includes three 0.003 microfarad radio frequency compensating capacitors 60, 62 and 64. These capacitors are connected respectively between a conductor 46 and contact 52, contact 52 and contact 54, and contact 54 and the system ground 14. Conductor 46 is connected to conductor 44 to receive power upon closing of the ignition switch 26. These capacitors filter out electrical signals that could otherwise cause the output on conductor 34 to vary even though the temperature sensed by the thermocouple 50 remains constant.

Transient protection circuit section 92 includes an NPN transistor 110 having its collector connected to conductor 102 and its emitter connected to a conductor 114 which leads to an input 106 of the voltage generator circuit 82. The base of transistor 110 is connected to the cathode of a zener diode 115 which in turn has its anode connected to the system ground 14. The collector of transistor 110 is connected to the base of the transistor through a 470 ohm resistor 118. The zener diode 115 breaks down at approximately ten volts and is normally in the break down mode during circuit operation. As a result, the current supplied to the base of transistor 110 is controlled. This limits the effect of positive going system transients, on line 44, on the signal on line 114 which is fed to the voltage generator.

The voltage generator 82 produces a constant direct current voltage output on a line 116. In the illustrated embodiment, this output is established at eight volts. The voltage generator also provides a circuit ground 56 which, together with the output on line 116, is isolated from the system battery 10. Output line 116 is connected to the comparator 180 and also by a conductor 120 to an input 122 of the reference temperature signal generator 48. Thus, voltage generator 82 provides a stable voltage source for the circuit 38.

With reference to FIG. 2, the voltage generator 82 includes an isolation transformer 130 having one side of its primary winding 131 connected by a conducter 133 to the collector of a first NPN transistor 134. The other side of the primary winding 131 is connected by conductor 137 to the collector of a second NPN transistor 136. The power supply input line 106 is connected to the center tap of the primary winding 131 and also to a ten microfarad input filter capacitor 139 which is connected to the system ground 14. The emitters of the transistors 134 and 136 are also connected together and to the system ground 14. The conductor 133 is connected through a twenty kilohm resistor 140 to the base of transistor 136 while the conductor 137 is connected through a similar resistor 142 to the base of the transistor 134. Also, conductors 133, 137 are coupled together by a 0.01 microfarad capacitor 144.

When connected in this manner, the transistors 134 and 136 oscillate with one conducting and then the other conducting, and vice versa. These transistors oscillate freely at a frequency of from approximately sixteen to eighteen kilohertz and produce a square wave output at their collectors. The capacitor 144 reduces ringing and overshoot in the transistor outputs. In addition, this capacitor reduces electrical noise which might otherwise be generated by the oscillator. Signals in primary winding 131 are coupled to the transformer secondary winding 132 and fed to a full wave rectifier 152 which operates in a conventional manner to produce a rectified DC output signal at conductor 154. Rectifier 152 also establishes the circuit ground 56. The DC output signal is filtered by a ten microfarad capacitor 156 and delivered to commercially available voltage regulator circuit 158. An example of a suitable voltage regulator is integrated circuit number 78L08 produced by National Semiconductor Company. The output of voltage regulator 158 is filtered by a 0.003 microfarad capacitor 160 and delivered to voltage generator output line 116. In this manner, voltage generator 82 produces a stable DC voltage for the control circuit 38. Of course, as known to those skilled in the art, any suitable voltage generator circuit may be utilized.

Referring again to FIG. 3, the operation of the comparator circuit 80 and reference signal generator circuit 48 will next be described. The input 122 of reference generator circuit 48 is connected through a 91 kilohm resistor 170 and a one hundred ohm potentiometer 172 to the circuit ground 56. The output of potentiometer 172 is adjustable and comprises the output 174 of the circuit 48. This output is connected by a conductor 176 to one input 178 of comparator circuit 80. The other input 180 of the comparator circuit is connected through a one kilohm resistor 70 to the conductor 34. Comparator circuit 80, in the illustrated form, comprises a commercially available integrated circuit comparator, such as integrated circuit LM 358A produced by the National Semiconductor Company. The output 182 of comparator 80 is fed through a 2.4 kilohm current limiting resistor 184 to the input 186 of the optical coupler circuit 84. A ten megohm feedback resistor 188 is connected between the input 180 and output 182 of the comparator circuit. In addition, a 0.1 microfarad capacitor 190 is connected between input 180 and the circuit ground 56 and cooperates with resistor 70 to filter the input signal transmitted to input 180 of the comparator circuit.

To limit the voltage swings at the input 180 of the comparator, a pair of diodes 192, 194 are provided. Diode 192 has its anode connected to circuit ground 56 and its cathode connected to input 180 while diode 194 is connected in the reverse. Therefore, the diode 194 limits positive swings in the voltage at input 180 while diode 192 limits negative voltage swings.

When connected in this manner, the voltage which reaches input 180 of the comparator circuit is a positive DC signal having a magnitude which corresponds to the engine temperature sensed by the sensor 32. Moreover, the output of the comparator circuit 80 is at a high level whenever the voltage at the input 180 of the comparator exceeds the voltage at the input 178 of the comparator. Thus, the comparator output is high whenever the engine temperature exceeds the predetermined reference temperature represented by the signal from reference generator 48.

The optical coupler circuit 84 includes a pair of light emitting diodes 200, 202 connected in series with the anode of diode 200 being connected to input 186, the cathode of diode 200 being connected to the anode of diode 202, and the cathode of diode 202 being connected to circuit ground 56. Whenever the output from the comparator circuit 80 is high, the diodes 200, 202 conduct and emit light. The optical coupler circuit 84 is commercially available and may comprise a dual optical coupler integrated circuit number ILCT 6, produced by Litronix Company. The diode 202 is optically coupled to a transistor 204 and a similar transistor 205 is optically coupled to the diode 200. When these transistors receive light from the diodes 200, 202, they conduct.

The collector of transistor 204 is connected by conductors 207 and 208 to the conductor 114 which receives power when delivered by conductor 44 to the control circuit 38. Also, the emitter of transistor 204 is connected to the base of a relay driving transistor 209. The base of transistor 209 is connected by a ten kilohm resistor 210 to the system ground. Leakage currents from transistor 204 pass to ground through resistor 210. The emitter of transistor 209 is connected to the system ground, while the collector of this transistor is connected to one end of a relay operating coil 88. The other end of this coil is connected to the conductor 102. Therefore, when the transistor 204 conducts, corresponding to a sensed engine temperature which is above the predetermined reference temperature and the ignition switch 26 is closed, the following takes place. Current flows from the system battery 10 through switch 26, conductor 44, diode 100, conductor 102, relay coil 88, transistor 209, and to the system ground 14. As a result, the relay coil 88 closes the relay 42. This connects the system battery, via conductor 28, to the engine controller 22.

A zener diode 212, having its anode connected to the emitter of transistor 209 and its cathode connected to the collector of this transistor is provided to protect the transistor from line transient voltage signals. The zener diode breaks down at approximately 30 volts and limits the voltage across the transistor 209. An additional transient protection diode 213 is also provided with its anode connected to the collector of transistor 209 and its cathode connected to conductor 102. Diode 213 limits the magnitude of the voltage spike generated by relay coil 88 when the coil's magnetic field collapses upon deenergization of the coil.

The monitoring circuit 90, in the illustrated form, is designed to provide an indication, typically visual, whenever the sensed temperature exceeds the reference temperature. More specifically, circuit 90 operates to provide such an indication whenever the transistor 205 is conducting and thus whenever the output of comparator circuit 80 is high. The illustrated monitoring circuit 90 includes a PNP current amplifier transistor 214 for driving a transistor 222 which in turn causes indicator 228 to operate and indicate that the engine is at an elevated temperature. Transistor 214 has its emitter connected to the line 208 and thereby to the power supplied on line 114. The base of transistor 214 is connected by a line 215 to the collector of the transistor 205 which in turn has its emitter connected to the system ground 14. A three kilohm resistor 216 is connected between the conductors 207 and 215. Resistor 216 provides a path for leakage currents from the output of transistor 205. Therefore, whenever transistor 205 conducts, a circuit path is provided from line 114 along lines 208 and 207, through the emitter base junction of transistor 214, along line 215, and through transistor 205 to the system ground. Under these conditions, base current is supplied to the transistor 214 and it begins to conduct. The collector of transistor 214 is connected through a 470 ohm drive current limiting resistor 220 to the base of an NPN transistor 222. The collector of transistor 222 is connected to the cathodes of a diode 226 and of a zener diode 224. The emitter of this transistor is connected to the anode of the diode 224 and also to the system ground. The anode of diode 226 is connected to one lead of an audio or visual indicator, such as a lamp or horn 228 which in turn is connected at its other lead by a conductor 230 to the conductor 20. The diode 224 protects the transistor 222 from voltage transients in line 230. In addition, diode 224 protects the transistor 222 from reverse bias leakage currents which could cause failure of the emitter base junction in the event voltage is applied in reverse across this junction. Diode 226 operates like diode 100 to protect the circuit in the event the negative battery terminal 12 is connected to the conductor 230.

When connected in this manner, at times that the transistors 204 and 205 conduct, current flows through the lamp 228 and causes it to emit light and indicate that the engine is operating at a temperature above the predetermined reference temperature. Lamp 228 may be positioned in the cab of a vehicle where it is visible to the vehicle operator.

Therefore, the overall operation of the apparatus is as follows. When the ignition switch 26 is initially closed, the circuit 38 is energized by way of conductor 44. If the engine temperature sensed by the temperature sensor 32 does not exceed a reference temperature represented by the reference temperature signal generated by generator circuit 48, the ouput from comparator 80 remains low and the relay controlled switch 42 remains open. If the ignition switch 26 is then opened under these conditions, the engine will immediately shut off.

However, as the engine runs and it's temperature rises, the sensed temperature may exceed the predetermined reference temperature. In this case, the output from the comparator circuit goes high. As a result, diodes 200, 202 emit light and transistors 204 and 205 conduct. As previously explained, a current path is then provided through the relay coil 88 and the relay 42 closes. In addition, a current path is also provided through the indicator 228 so that a visual indication of the condition of the engine is provided to the vehicle operator. Then, if the ignition switch is opened, current continues to flow from the system battery 10 through relay 42 to the engine controller 22 and the engine continues to operate and is cooled by coolant circulated by the operating engine. The engine remains operational until such time as the sensed engine temperature drops below the predetermined reference temperature. When this happens, the output from the comparitor circuit 80 drops to a low level and diodes 200 and 202 no longer emit light. This in turn causes transistors 204 and 205 to cease conducting. As a result, transistor 209 no longer conducts and current flowing through the relay coil 88 is interrupted. This causes relay 42 to open and deenergizes the engine controller. Consequently, the engine shuts off. Also, the current path through the lamp 228 is opened as well. The engine remains off until such time as the ignition switch is again energized and the engine started.

In the event manual override 47 is opened, the circuit functions as before. However, if the ignition switch is opened, the engine stops. That is, in this case, even if the relay 42 happens to be closed, the open switch 47 prevents current from passing along conductor 28 from the system battery to the engine controller. In this manner, the apparatus may easily be disabled in the event this is desired. For example, when mechanics are working on the engine.

Furthermore, as previously explained, the predetermined reference temperature may be varied by adjusting the reference signal generated by generator circuit 48.

Having illustrated and described the principles of my invention with reference to one preferred embodiment, it should be apparent to those persons skilled in the art that such invention may be modified in arrangement and detail without departing from such principles. For example, conductor 28 may, instead of being connected to a conductor 20 leading to the engine controller 22, be connected to the controller for an auxiliary pump. Such a pump being operable to circulate coolant and lubricating fluid through the engine, after the engine is shut off by the ignition switch, until such time as the engine temperature drops to a desired level. Therefore, I claim as my invention all such modifications as come within the true spirit and scope of the following claims.

I claim:

1. A temperature responsive engine control apparatus comprising:

temperature sensing means for sensing the temperature of the engine and producing an engine temperature output signal corresponding to the sensed engine temperature;

engine control means responsive to said engine temperature output signal of said temperature sensing means for selectively preventing the engine from shutting off depending upon the magnitude of the sensed engine temperature, said engine control means including reference temperature circuit means for producing a reference temperature output signal corresponding to a predetermined temperature, said engine control means including comparator means for receiving and comparing the engine temperature output signal and the reference temperature output signal and for producing a comparator output signal corresponding to the relationship between the sensed engine temperature and reference temperature, said engine control means also including means for receiving said comparator output signal and preventing the engine from shutting off when the comparator output signal corresponds to a sensed engine temperature which is above the predetermined temperature.

2. In a vehicle having an engine, an exhaust for venting products of combustion from the engine, and an ignition switch for selectively connecting a power source to an engine controller to operate the engine, a temperature responsive engine control mechanism comprising:

temperature sensing means for sensing the temperature of the engine and for producing an engine temperature output signal corresponding to the sensed engine temperature;

engine control means responsive to said engine temperature output signal of said temperature sensing means for selectively connecting the power source to the engine controller while the engine temperature is above a threshold temperature so as to maintain the engine in operation under such conditions; said engine control means comprising a bypass circuit path which is connected from the power source to the engine controller in parallel with the ignition switch, and control switch means for closing the bypass circuit path while the engine temperature is above the threshold temperature, said engine control means including reference temperature circuit means for producing a reference temperature output signal corresponding to a predetermined temperature, said engine control means including comparator means for receiving and comparing the engine temperature output signal and the reference temperature output signal and for producing a comparator output signal which corresponds to the relationship between the engine temperature and reference temperature, said control switch means being responsive to said comparator output signal to close the bypass circuit path and prevent the engine from shutting off when the comparator output signal corresponds to a sensed engine temperature which is above the predetermined temperature.

3. In a vehicle having an engine, an exhaust for venting products of combustion from the engine, and an ignition switch for selectively connecting a power source to an engine controller to operate the engine, a temperature responsive engine control mechanism comprising:

temperature sensing means for sensing the temperature of the engine and for producing an engine temperature output signal corresponding to the sensed engine temperature;

engine control means responsive to said engine temperature output signal of said temperature sensing means for selectively connecting the power source to the engine controller while the engine temperature is above a threshold temperature so as to maintain the engine in operation under such conditions, said engine control means comprising a bypass circuit path which is connected from the power source to the engine controller in parallel with the ignition switch, and control switch means for closing the bypass circuit path while the engine temperature is above the threshold temperature; and manual override means for preventing said engine control means from connecting the power source to the engine controller.

4. An apparatus according to claim 3 in which said manual override means comprises override switch means for opening the bypass circuit path to prevent the engine control means from connecting the power source to the engine controller.

* * * * *